United States Patent [19]

Wainwright et al.

[11] Patent Number: 4,693,153

[45] Date of Patent: Sep. 15, 1987

[54] METHOD AND APPARATUS FOR CONTROLLING THE CUTTING OF AN OBJECT

[75] Inventors: Ronald C. Wainwright, Hertfordshire; Lawrence R. Beesley, Essex, both of England

[73] Assignee: Gunson's Sortex Limited, London, England

[21] Appl. No.: 755,820

[22] Filed: Jul. 17, 1985

[30] Foreign Application Priority Data

Jul. 27, 1984 [GB] United Kingdom ..... 84 19185

[51] Int. Cl.[4] ..... B26F 3/00

[52] U.S. Cl. ..... 83/53; 51/321; 51/439; 83/177; 239/433; 239/586; 239/DIG. 8

[58] Field of Search ..... 83/53, 177, 925 CC, 83/104; 239/DIG. 8, 433, 586; 51/321, 439, 320; 299/17

[56] References Cited

U.S. PATENT DOCUMENTS

| | | | |
|---|---|---|---|
| 978,835 | 12/1910 | Bowers | 51/439 X |
| 3,532,014 | 10/1970 | Franz | 83/177 X |
| 3,770,110 | 11/1973 | Boskovitch | 83/104 X |
| 4,246,838 | 1/1981 | Pulver et al. | 83/53 X |
| 4,576,071 | 3/1986 | Rayment | 83/371 X |

*Primary Examiner*—Frank T. Yost

*Attorney, Agent, or Firm*—Cushman, Darby & Cushman

[57] ABSTRACT

A method of controlling the cutting of an object comprising pressurizing a fluid; forming from said pressurized fluid a fluid jet adapted to cut the object; directing the said object-cutting jet towards the object and, when it is not desired to cut the object, preventing the object-cutting jet from reaching the object while maintaining the pressurization of the fluid.

5 Claims, 7 Drawing Figures

METHOD AND APPARATUS FOR CONTROLLING THE CUTTING OF AN OBJECT

Figure 1:
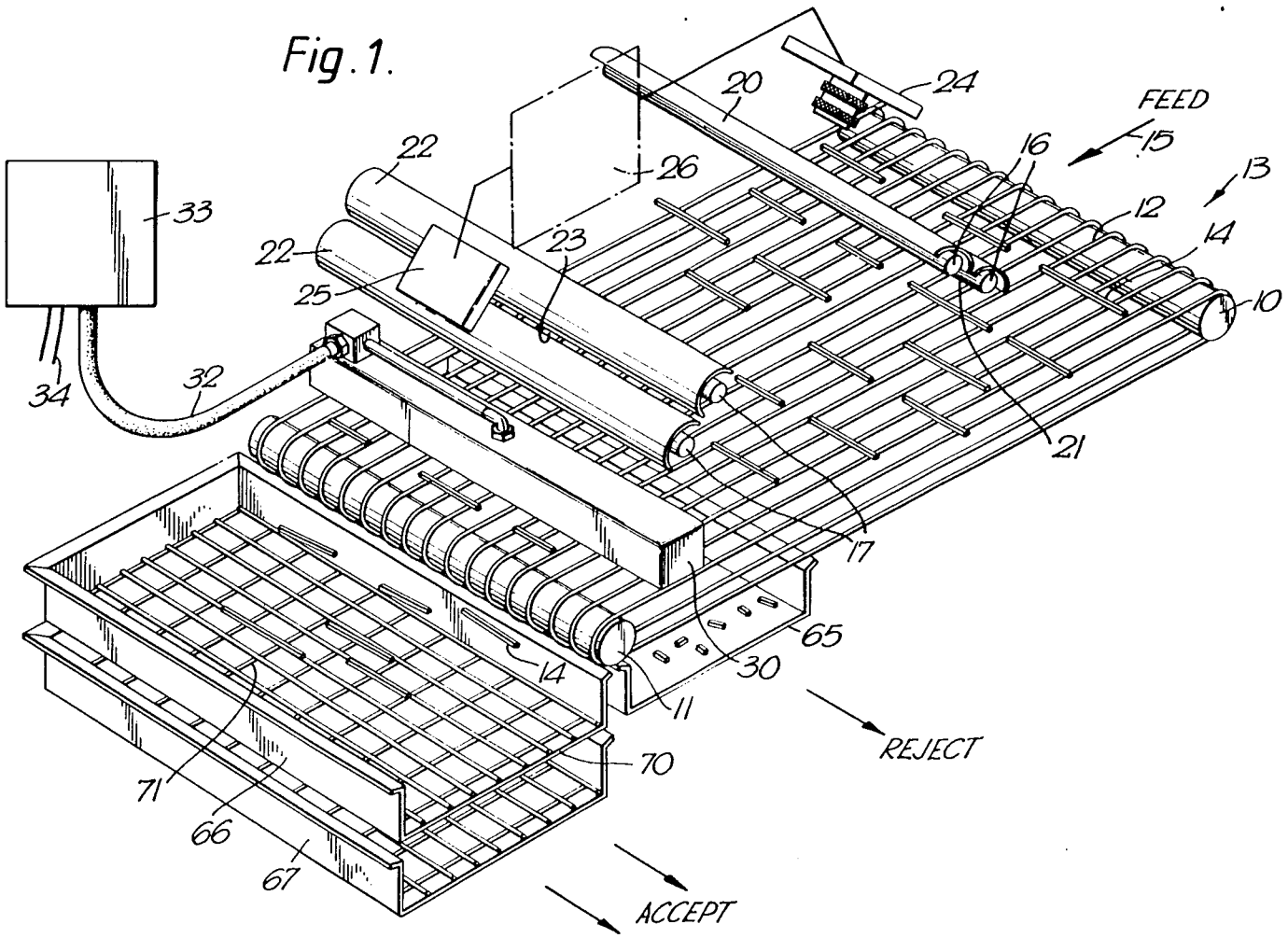

This invention concerns a method and an apparatus for controlling the cutting of an object.

It is known to employ a fine jet of water at a very high pressure for cutting purposes. In many cutting operations, however, it is necessary to start and stop the cutting very rapidly and this cannot be achieved merely by ceasing to pressurise the water.

Although, therefore, the present invention is primarily directed to any novel integer or step, or combination of integers or steps, as herein disclosed and/or as shown in the accompanying drawings, nevertheless, according to one particular aspect of the present invention, to which, however, the invention is in no way restricted, there is provided a method of controlling the cutting of an object comprising pressurising a fluid; forming from said pressurised fluid a fluid jet adapted to cut the object; directing the said object-cutting jet towards the object and, when it is not desired to cut the object, preventing the object-cutting jet from reaching the object, or impairing the object-cutting properties of the jet, while maintaining the pressurisation of the fluid.

Preferably the cutting of the object involves cutting right through the object, although the cutting could be such as to remove a portion of or to cut a slit in an object.

The fluid is preferably passed through a nozzle to form the object-cutting jet.

The object-cutting jet may be prevented from reaching the object by introducing a jet obstructor member into the path of the object-cutting jet. Such a jet obstructor member is preferably connected to the plunger of a solenoid device which is arranged to move the jet obstructor member into and out of the path of the object-cutting jet.

Alternatively, the object-cutting jet may be prevented from reaching the object by dispersing the jet before it reaches the object. For example, a fluid may be introduced into the object-cutting jet so as to disperse the latter.

In one embodiment of the present invention, there is introduced into said nozzle a further fluid which prevents the formation of a jet capable of cutting the object.

In another embodiment of the present invention, the object-cutting jet is prevented from reaching the object by directing the object-cutting jet away from the object. Thus the nozzle may be moved to direct the object-cutting jet away from the object. Such movement of the nozzle may, for example, be effected by tilting the fluid container. Alternatively, a fluid may be directed onto the object-cutting jet so as to deflect the latter away from the object.

In the preferred form of the present invention, the object is first examined and, if it has an undesired portion, the object-cutting jet is employed to cut the object so as to effect relative separation between the undesired portion and the remaining portion of the object.

The object is preferably cut in such a way that the length of the undesired portion does not exceed a predetermined value, the undesired portion being thereafter removed by passing it through a gap whose width is of the said predetermined value.

The object may, for example, be an uncooked potato chip which is examined to determine whether it has blemishes or discolourations.

The invention also comprises apparatus for controlling the cutting of an object comprising means for pressurising a fluid so as to form therefrom a fluid jet adapted to cut an object; means for supporting the object in a position in which it may be cut by the object-cutting jet; means for directing the object-cutting jet towards the said position; and means, operable when desired, for preventing the object-cutting jet from reaching the object, or for impairing the object-cutting properties of the jet, while maintaining the pressurisation of the fluid.

The said apparatus may comprise viewing means for viewing the object, and control means under the control of the viewing means for allowing or preventing the objectcutting jet reaching the object, or for impairing the object-cutting properties of the jet, in dependence upon whether the object has an undesired portion which is to be relatively spearated from the remaining portion of the object. In this case, the control means may be such that the length of the undesired portion does not exceed a predetermined value, there being a gap whose width is of the said predetermined value, and through which the undesired portion falls.

Figure 2:
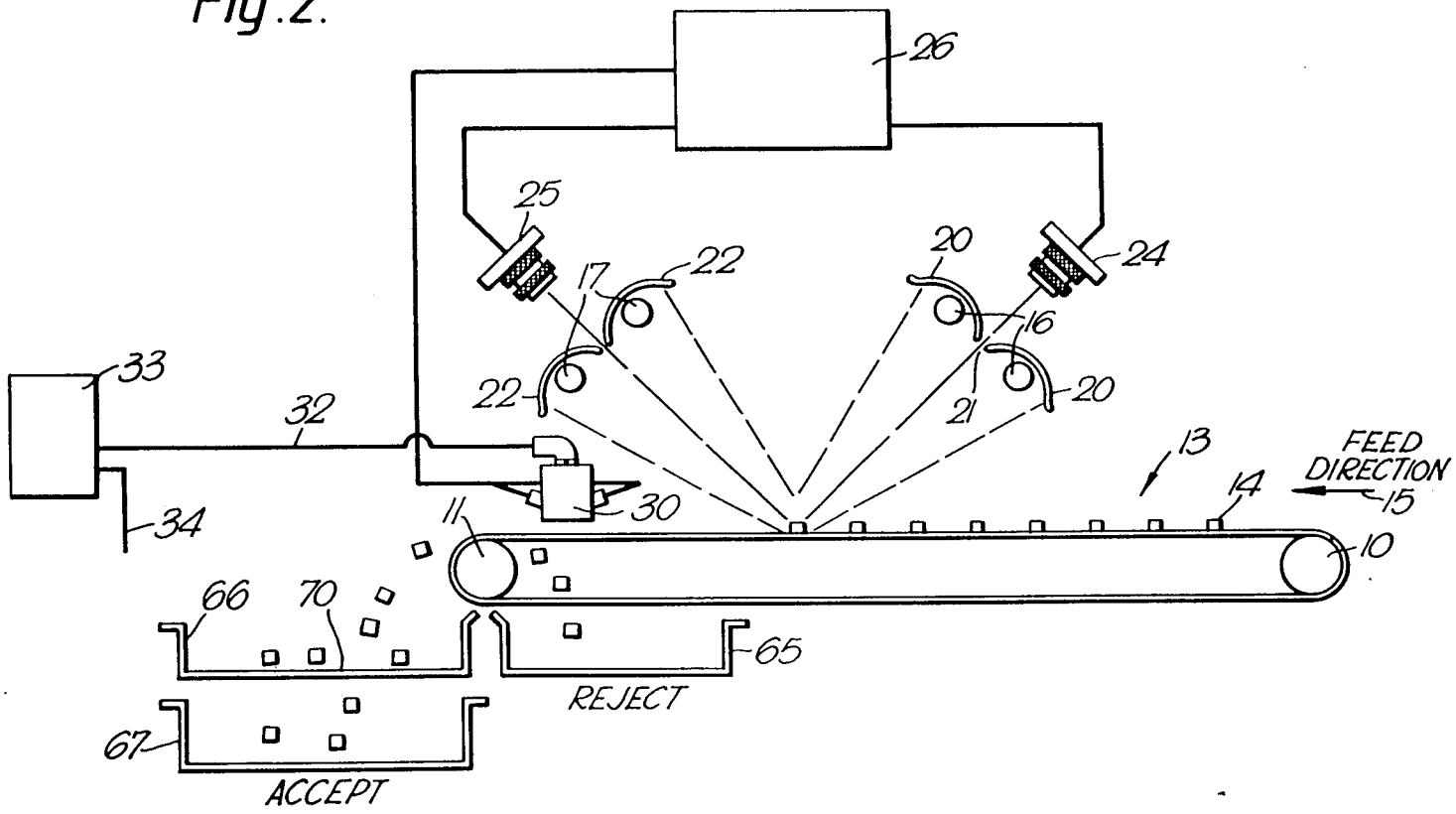
Figure 3:
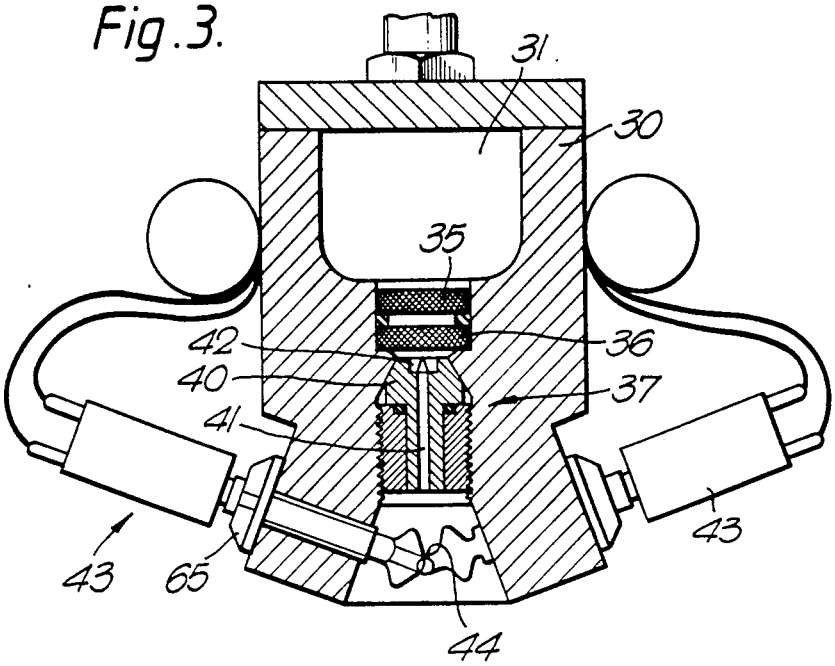
Figure 4:
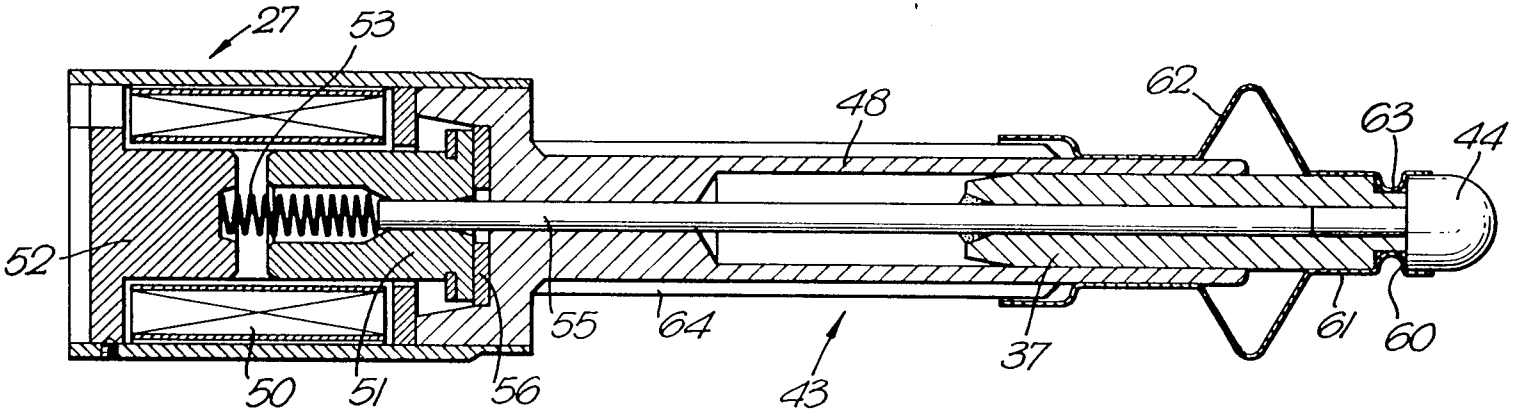

The invention is illustrated, merely by way of example, in the accompanying drawings, in which:

FIGS. 1 and 2 are respectively a diagrammatic perspective view and a side view of a first embodiment of an apparatus according to the present invention for controlling the cutting of an object, FIG. 3 is a sectional elevation on a larger scale of a part of the apparatus shown in FIGS. 1 and 2, FIG. 4 is a sectional view on a still larger scale of a jet obstructor device which forms part of the construction shown in FIG. 3.

Figure 7:
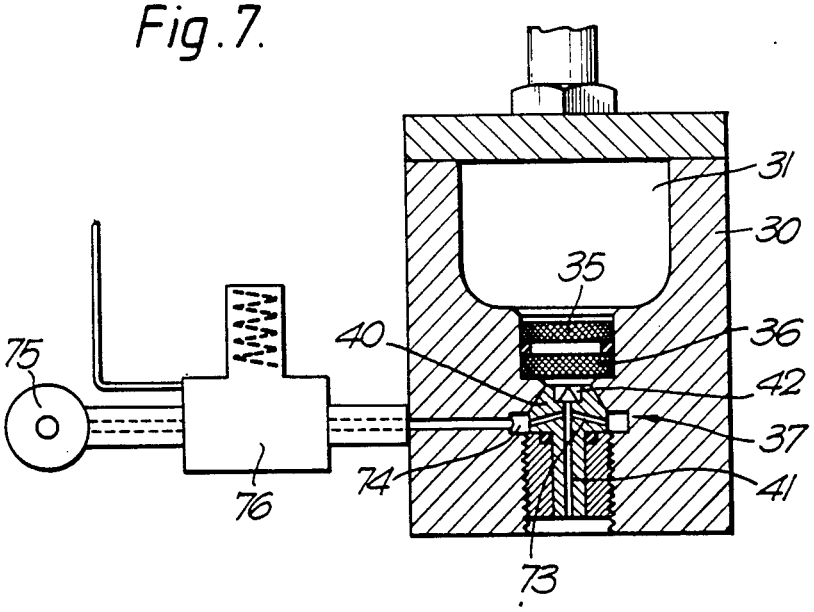
Figure 5:
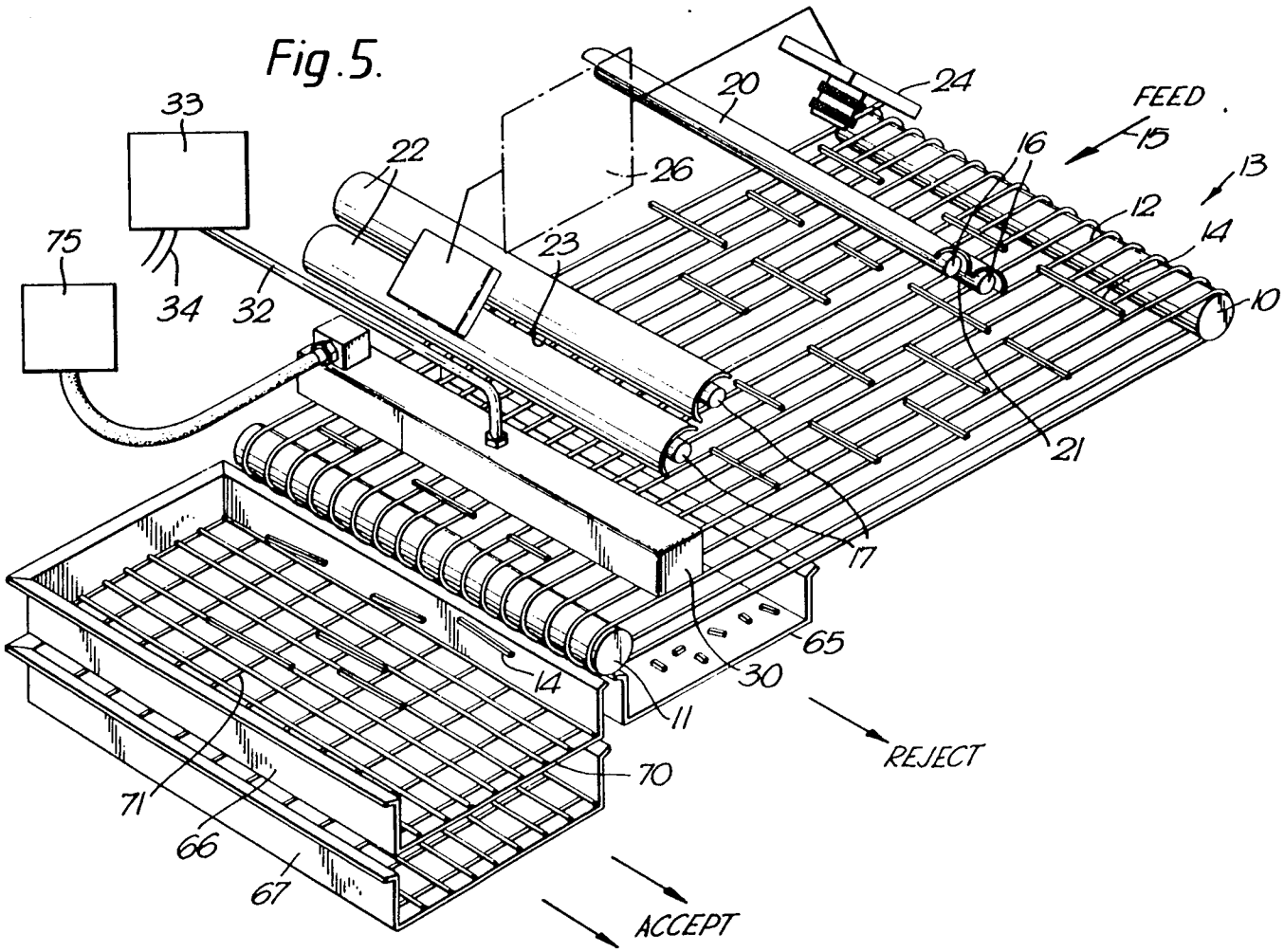
Figure 6:
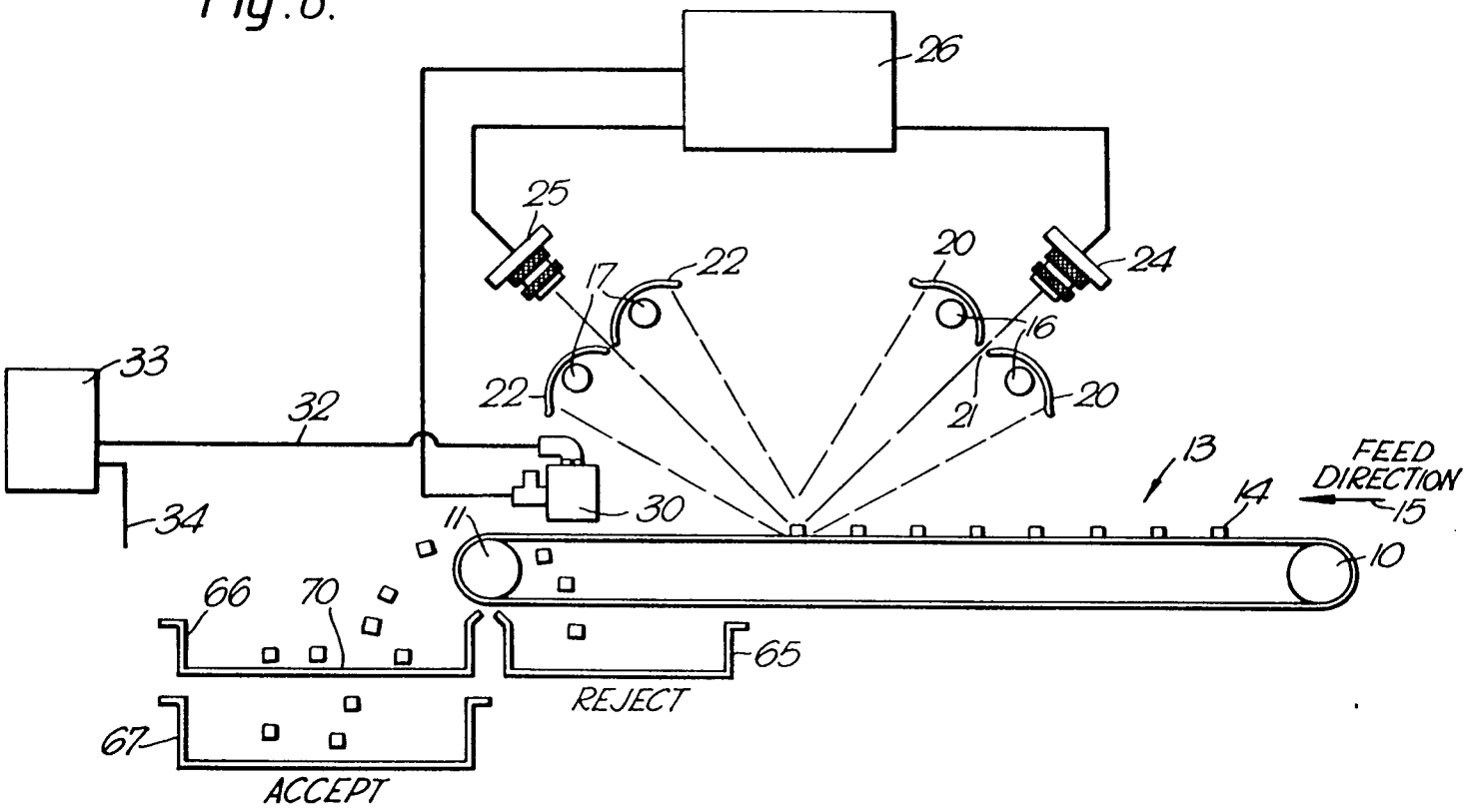

FIGS. 5 and 6 are respectively a diagrammatic perspective view and a side view of a second embodiment of an apparatus according to the present invention for controlling the cutting of an object, and FIG. 7 is a sectional view on a larger scale of part of the apparatus shown in FIGS. 5 and 6.

In FIGS. 1 and 2 there is shown a first embodiment of an apparatus according to the present invention which comprises spaced apart rollers 10, 11 which are rotated by means not shown. A series of narrow belts 12, which are spaced from each other by constant distances of, say, $\frac{1}{4}''$ to $\frac{1}{2}''$ (0.635 to 1.27 cm), are entrained around the rollers 10, 11, so as collectively to provide an endless feed belt 13 which is arranged to carry uncooked potato chips or slices 14 in a feed direction indicated by arrow 15.

Mounted above the feed belt 13, so as to extend across the width of the latter, is a first, or upstream pair of fluorescent tubes 16 and a second, or downstream, pair of fluorescent tubes 17. Each of the fluorescent tubes 16 is mounted within a part-cylindrical casing 20 which is spaced from the adjacent part-cylindrical casing 20 by a gap 21. Similarly, each of the fluorescent tubes 17 is mounted in a part-cylindricalcasing 22 which is spaced from the adjacent part-cylindrical casing 22 by a gap 23. Scanning cameras 24, 25 "look" respectively through the gaps 21, 23 so as to view potato chips 14 disposed substantially midway between the scanning cameras 24, 25. The scanning cameras 25, 25 thus view opposite sides of the potato chips 14.

In order to simplify the drawings, only one scanning camera 24 and only one scanning camera 25 is shown.

In practice, however, there would either be a row of scanning cameras disposed adjacent to each pair of fluorescent tubes 16, 17, these scanning cameras being arranged collectively to view the whole width of the feed belt 13, or each of the scanning cameras 24, 25 could extend the whole width of the feed belt 13 and could be constituted by a linear photodiode array camera having a sufficient number of photodiodes to resolve defects on the potato chips 14 which are capable of being handled across the width of the feed belt 13. Thus if the feed belt 13 is designed to handle one hundred potato chips 14 across its width, each of the said linear photodiode array cameras may be provided with an array of 100 or more photodiodes.

Although reference has been made to potato chips 14, the apparatus shown in the drawings is suitable for handling other objects which are capable of being cut by water jets. The potato chips 14 (or other objects) may either be arranged, as shown, in a plurality of parallel lines each of which extends transversely of the feed belt 13, or may be distributed randomly over the latter.

Each of the scanning cameras 24, 25 is connected to a central processing unit 26. The central processing unit 26 is arranged to compare the signal from each of the scanning cameras 24, 25, or from each of the said diodes, with a datum so as to determine whether the particular potato chip 14 being viewed has an undesired portion caused by a black blemish or other discolouration. If there is such an undesired portion, a signal is passed, after a delay, to a respective solenoid device 27 (FIG. 4) whose function is described below.

Mounted above and so as to extend across the width of the feed belt 13 is a housing 30 having a chamber 31 therein which is arranged to receive water at a very high pressure, e.g. of 10,000 pounds per square inch (68947.6 kPa). The high pressure water is supplied to the chamber 31 by way of an outlet pipe 32 connected to the output side of a piston pump 33 having an inlet pipe 34.

The high pressure water in the chamber 31 which has been so pressurised by the piston pump 33 is passed through a series of filters comprising at least one relatively coarse filter 35 and at least one relatively fine filter 36, the filters 35, 36 being mounted beneath the chamber 31. For example, there may be two relatively coarse filters 35 each of which is sized to remove particles whose diameter exceeds 5 microns, and one relatively fine filter 36 which is sized to remove particles whose diameter exceeds 2 microns.

Mounted immediately beneath the relatively fine filter 36 is a row of jet nozzles 37 (only one shown). The row may, for example, consist of one hundred jet nozzles 37 which are spaced from each other by distances of $\frac{1}{4}''$ to $\frac{1}{2}''$ (0.635 to 1.27 cm). As shown in FIG. 3, each jet nozzle 37 comprises a body member 40 having a jet passage 41 therethrough for receiving pressurised water which has passed through the filters 35, 36 and through a sapphire nozzle member 42 mounted at the top of the body member 40. Each liquid jet passage 41 may have a diameter of, say, 0.003" (76.2 μm). Accordingly, a plurality, e.g. 100, of really fine water jets will be provided across the width of the feed belt 13.

Mounted adjacent to the path of each of the water jets is a jet obstructor device 43. The jet obstructor devices 43 are arranged alternately on opposite sides of the water jets and are spaced from each other in the direction of the width of the feed belt 13 by distances corresponding to the distances between the jet nozzles 37. Each jet obstructor device 43 comprises a sapphire jet obstructor member 44 which is movable between an operative position, shown in FIG. 3, in which the jet obstructor member 44 is disposed in the path of the respective water jet so as to prevent the latter from reaching and thus cutting a potato chip 14, and an inoperative position, not shown, in which the jet obstructor member 44 is retracted so as to be spaced from the respective water jet, whereby the latter can reach and thus cut the potato chip 14.

As shown in FIG. 4, each jet obstructor device 43 has a housing 48 at one end of which there is provided the solenoid device 27 referred to above. The solenoid device 27 has a coil 50 which is encapsulated in plastics material. The solenoid device 27 is provided with a plunger 51 which is held apart from a core member 52 by a spring 53 so that, when the solenoid device 27 is energised, the plunger 51 is urged towards the core member 52 and is spaced therefrom by a gap 54, e.g. of 1.0 mm. The plunger 51 is mounted on and secured to a rod 55 which is slidably mounted in the housing 48, the plunger 51 being engageable with a buffer 56 when the solenoid device 27 is de-energised. Secured to the rod 55 is a tubular member 57, e.g. of nylon or of Tufnol (Trade Mark), the tubular member 57 being slidably mounted within the housing 48. The jet obstructor member 44 is mounted at the end of the tubular member 57 remote from the solenoid device 27 and is secured thereto by adhesive 60. A tubular steel member 61, having a bellows portion 62, has one part which is mounted on the housing 48 and another part which is mounted on the tubular member 57 and which is held thereon by a stainless steel wire ring 63. The tubular steel member 61 serves to seal the connection between the housing 48 and the tubular member 57, The housing 48 has a threaded portion 64 onto which is threaded a nut member 65 (FIG. 3) which engages the housing 30.

As indicated above, the central processing unit 26, whenever a potato chip 24 being viewed has an undesired portion caused by a black blemish or other discolouration, produces a signal which, after a delay, is passed to the respective solenoid device 27 so as to energise the latter and thus retract the respective jet obstructor member 44 from the path of the respective water jet. The said delay is such that, during the delay, the defective potato chip 14 is carried by the feed belt 13 to a position in which the defective potato chip 14 becomes aligned with the respective water jet so that the undesired portion is cut away from the remaining portion of the potato chip 14. The delay is, moreover, such that any undesired portion of the potato chip 14 which is so cut away is of a predetermined length, e.g. 1 cm. If, for example, a potato chip 14 has a black blemish at one end thereof which extends to a position 4 mm from said end, the portion which is cut away will extend 1 cm from said end. If, however, the black blemish extends for, say, 1.2 cm, and is in the middle of the potato chip 14, the potato chip 14 will be cut twice so as to produce two blemished portions each of which is 1 cm long. Thus if the whole potato chip 14 is blemished, it will be completely cut up by means of cuts which are spaced apart from each other by 1 cm. The water from a water jet which has been so used to cut a potato chip 14 passes through the spaces between the belts 12 and is passed to waste.

When, however, a good potato chip 14 passes beneath the respective scanning cameras 24, 25, the respective solenoid device 27 is, after the said delay, de-energised and the respective jet obstructor member 44 is disposed in its operative position. As a result, when the good potato chip 14 has travelled to a position in alignment with the respective water jet, the latter strikes the jet obstructor member 44 and is dispersed so as to form a spray or mist the water from which may be collected in a tray (not shown).

Mounted below the feed belt 13 so as to be aligned with the housing 30 is a reject chute 65. The undesired portions of the potato chips 14, which have been cut into the predetermined length, e.g. of 1 cm, fall through the spaces between the belts 12 and pass into the reject chute 65 which is vibrated by an electro-magnetic or other vibrator (not shown) so that these undesired portions are rejected. Those potato chips 14 which are not blemished, however, and which will have a length greater than 1 cm, will not fall through the spaces between the belts 12 and will instead pass to an upper tray 66 which is mounted above a lower tray 67. Each of the trays 66, 67 is vibrated, e.g. by an electro-magnetic vibrator, (not shown) in a direction transverse to the feed direction 15. The upper tray 66 has a bottom wall 70 constituted by a grid having bars 71 which extend in the feed direction 15 and which are spaced from each other by a predetermined spacing. Potato chips 14 whose length is less than the said spacing will therefore fall through the grid 70 and pass to the lower tray 67. Thus the trays 66, 67 collectively constitute a length grader. Potato chips from the upper and lower trays 66, 67, which have been so graded, constitute acceptable potato chips which are passed away, as indicated in FIG. 1, in a direction transverse to the feed direction 15.

Alternatively, if desired, the feed belt 13, instead of having a series of longitudinal spaces between its belts 12, could be constituted by a single belt which is spaced by a gap, e.g. of 1 cm, from a further belt aligned therewith. In this case, all the undesired portions of the potato chips, whose length will be less than 1 cm, will fall through the said gap, while the majority of the good portions of the potato chips, which will have a length greater than 1 cm, will travel over the gap and onto the second belt.

Throughout the operation described above, the piston pump 33 is driven to maintain the pressurisation of the water used to form the water jets. Thus the cutting, when necessary, of the potato chips 14 can be finely controlled since the solenoid devices 27 can be operated at very high speeds. If, on the other hand, the water jets were to be interrupted when needed by controlling a flow of water to form the jets, or by controlling the operation of the piston pump 33 which raises the pressure of the water to the required level, it would not be possible to control the water jets at the same speed.

Although the viewing devices constituted by the scanning cameras 24, 25 are shown as being disposed above the potato chips 14, they may be such as to view the potato chips on the three exposed sides thereof. Moreover, if the feed belt 13 is transparent, the sides of the potato chips which are mounted on the feed belt 13 may also be viewed.

In FIGS. 5–7 there is shown a second embodiment of an apparatus according to the present invention which is generally similar to that shown in FIGS. 1 and 2 and which, for this reason, will not be described in detail, like reference numerals indicating like parts.

In the construction of FIGS. 5–7, however, no use is made of jet obstructor devices 43 and, instead, air is, when required, introduced into the water jet so as to disperse the latter.

Thus, as shown in FIG. 7, the body member 40 of each jet nozzle 37 is provided with radial passages which communicate both with the jet passage 41 and with an annular air manifold 74. A source 75 of compressed air, e.g. at a pressure of 80 pounds per square inch (551.6 kPa), is connected via a solenoid valve 76 to the air manifold 74. The operation of the solenoid valve 76 is controlled by the central processing unit 26 so that, when a defective potato chip 14 is viewed, the solenoid valve 76 is closed, whereby compressed air is not supplied to the air manifold 74. Accordingly, the undesired portion of the defective potato chip 14 will be cut away.

When, however, a good potato chip 14 is viewed, the solenoid valve 76 is opened so that compressed air is supplied to the air manifold 74 and thus to the jet passage 41. Consequently, the compressed air is introduced into the water jet so as to impair the object-cutting properties of the latter and so as to disperse it. Any water reaching the good potato chip 14 will therefore fail to cut it. Thus control of the cutting of the potato chip 14 is achieved by controlling the supply of compressed air to the air manifold 74.

We claim:

1. A method of controlling the cutting of an object comprising:

pressurizing a first fluid, passing said pressurized first fluid through a nozzle to form a fluid jet adapted to cut the object;

directing said object-cutting jet towards the object and, when it is not desired to cut the object, introducing into said nozzle a further fluid which prevents the formation of a jet capable of cutting the object, the introduction of the further fluid into the nozzle being effected while maintaining the pressurization of the first fluid.

2. A method of controlling the cutting of an object comprising:

pressurizing a first fluid;

forming from said pressurized first fluid, a fluid jet adapted to cut the object;

directing said object-cutting jet towards the object and, when it is not desired to cut the object, introducing a second fluid into the object-cutting jet so as to disperse the latter before it reaches the object, the introduction of the second fluid into the object-cutting jet being effected while maintaining the pressurization of the first fluid.

3. A method of controlling the cutting of an object comprising:

pressurizing a first fluid;

forming from said pressurized first fluid, a jet adapted to cut the object;

directing said object-cutting jet towards the object and, when it is not desired to cut the object, directing a second fluid onto the object-cutting jet so as to deflect the latter away from the object while maintaining the pressurization of the first fluid.

4. Apparatus for controlling the cutting of an object comprising:

means for pressurizing a first fluid so as to form therefrom a fluid jet adapted to cut an object;

means for supporting the object in a position in which it may be cut by the object-cutting jet;

means for directing the object-cutting jet towards said position;

and means, operable when desired, for introducing a second fluid into the object-cutting jet so as to disperse the latter and impair its object-cutting properties while maintaining the pressurization of the first fluid.

5. Apparatus for controlling the cutting of an object comprising;

means for pressurizing a first fluid so as to form therefrom a fluid jet adapted to cut an object;

means for supporting the object in a position in which it may be cut by the object-cutting jet;

means for directing the object-cutting jet towards said position, and means, operable when desired, for directing a second fluid against the object-cutting jet so as to deflect the latter and impair its object-cutting properties while maintaining the pressurization of the first fluid.

* * * * *